US006861101B1

(12) United States Patent
Kowalsky et al.

(10) Patent No.: US 6,861,101 B1
(45) Date of Patent: Mar. 1, 2005

(54) PLASMA SPRAY METHOD FOR APPLYING A COATING UTILIZING PARTICLE KINETICS

(75) Inventors: Keith A Kowalsky, East Norwich, NY (US); Daniel R Marantz, Ocean Ridge, FL (US)

(73) Assignee: Flame Spray Industries, Inc., Fort Washington, NY (US)

( * ) Notice: Subject to any disclaimer, the term of this patent is extended or adjusted under 35 U.S.C. 154(b) by 112 days.

(21) Appl. No.: 10/324,988

(22) Filed: Dec. 19, 2002

Related U.S. Application Data

(60) Provisional application No. 60/346,540, filed on Jan. 8, 2002.

(51) Int. Cl.[7] ..... C23C 4/06; C23C 4/12

(52) U.S. Cl. ..... 427/455; 427/446; 427/447; 427/452; 427/453; 427/456

(58) Field of Search ..... 427/446, 447, 427/452, 453, 455, 456

(56) References Cited

U.S. PATENT DOCUMENTS 4,916,273 A * 4/1990 Browning ..... 219/121.47
5,302,414 A 4/1994 Alkhimov et al.
6,139,913 A 10/2000 Van Steenkiste et al.
2002/0168466 A1 * 11/2002 Tapphorn et al. ..... 427/180

OTHER PUBLICATIONS

U.S. Provisional Application 60/286,256, filed Apr. 24, 2001.*

* cited by examiner

*Primary Examiner*—Katherine Bareford
(74) *Attorney, Agent, or Firm*—Carmody & Torrance LLP

(57) ABSTRACT

A method of operation of a plasma torch. A cold high pressure carrier gas containing a powder material is injected into a cold main high pressure gas flow and then this combined flow is directed coaxially around a plasma exiting from an operating plasma generator and converging into the hot plasma effluent, mixing with the effluent to form a gas stream with a net temperature, based on the enthalpy of the plasma stream and the temperature and volume of the cold high pressure converging gas, such that the powdered material will not melt. The combined flow with entrained is directed through a supersonic nozzle accelerating the flow to supersonic velocites sufficient that the particles striking the workpiece achieve kinetic energy transformation into elastic deformation of the particles as they impact the workpiece forming a cohesive coating.

30 Claims, 6 Drawing Sheets

PLASMA SPRAY METHOD FOR APPLYING A COATING UTILIZING PARTICLE KINETICS

CROSS REFERENCE TO RELATED APPLICATIONS

This invention claims priority to Provisional Application Ser. No. 60/346,540 filed. Jan. 8, 2002 titled "PLASMA SPRAY METHOD AND APPARATUS FOR APPLYING A COATING UTILIZING PARTICLE KINETICS", by Keith Kowalsky and Daniel Marantz.

FIELD OF INVENTION

The present invention is directed to a method and device for low temperature, high velocity particle deposition onto a workpiece surface from an internal plasma generator, and more particularly to a thermal spray method and device in which the in-transit temperature of the powder particles is below their melting point and wherein a cohesive coating is formed by conversion of kinetic energy of the high velocity particles to elastic deformation of the particles upon impact against the workpiece surface.

BACKGROUND OF THE INVENTION

Until Recently, in thermal spraying, it has been the practice to use the highest temperature heat sources to spray metal and refractory powders to form a coating on a workpiece surface. The highest temperature processes currently in use are plasma spray devices, both using an open arc as well as a constricted arc. These extremely high temperature devices operate at 12,000° F. to 16,000° F. to spray materials, which melt at typically under 3,000° F. Overheating is common with adverse alloying and/or excess oxidation occurring. These problems also occur to a lesser or greater degree during the use of the more recently developed HVOF (high velocity oxy-fuel) processes as well as HVAF (high velocity air-fuel) processes. Both of these are combustion type processes utilizing pure oxygen or air containing oxygen as the-oxidizer in the combustion process.

Another prior art method of applying a coating is described in U.S. Pat. No. 5,302,414 Alkhimov et al, issues Apr. 12, 1994, which describes a cold gas-dynamic spraying method for applying a coating of particles to a workpiece surface, the coating being formed of a cohesive layering of particles in solid state on the surface of the workpiece. This is accomplished by mixing powder particles having a defined size of from 1 to 50. microns entrained in a cold high pressure carrier gas into a preheated high pressure gas flow, followed by accelerating the gas and particles into a supersonic jet to velocities of 300 to 1000 meters per second, while maintaining the gas temperature sufficiently below the melt temperature so as to prevent the melting of the particles. In the operation of this cold gas-dynamic spraying method there are a set of critically defined parameters of operation (particle size and particle velocity for any given material) which makes the process very sensitive to control while maintaining consistent coating quality as well as maintaining useful deposit efficiencies. In addition, the cold gas dynamic spray method as described by Alkhimov et al, is limited to the use of 1–50 micron size powder particles.

Another prior art method of coating is described in U.S. Pat. No. 6,139,913, Van Steenkiste et al, which describes a kinetic spray coating method and apparatus to coat a surface by impingement of air or gas with entrained powder particle in a range of up to at least 106 microns and accelerated to supersonic velocity in a spray nozzle and preferably utilizing particles exceeding 50 microns. The use of powder particles greater than 50 microns overcomes the limitation disclosed by Alkhimov et al. Van Steenkiste et al, while utilizing the same general configuration of the prior art in which the cold high pressure carrier gas with entrained powder material is injected downstream of the heating source of the main high pressure gas into the heated main high pressure gas overcomes the limitations of Alkhimov et al by controlling the ratio of the area of the powder injection tube to 1/80 relative to the area of the main gas passage. By controlling this ratio, it limits the relative volume of cold carrier gas flowing into the heated main gas flow, thereby causing a reduced degree of temperature reduction of the heated main high pressure gas. The net temperature of the main high pressure gas when mixed with the carrier/powder gas flow is critical to determining the velocity of the gas exiting the supersonic nozzle and thereby to the acceleration of the powder particles. As indicated by Alkhimov et al, a critical range of particle velocity is required in order that a cohesive coating is formed. The particle size, the net temperature of the gas and the volume of the gas determine the gas dynamics required to produce a particle velocity falling into the critical particle velocity range.

The cold gas dynamic spray method of Alkhimov et al is limited to the use of a particle size range of 1–50 micron. This limitation has been found by Van Steenkiste et al to be due to the heated main high pressure-gas being cooled by injecting into it the cold high pressure carrier gas/powder. Because of the reduction in gas temperature, the maximum gas velocity that can be achieved is too low to accelerate powder particles larger than 50 microns to the critical velocity required to achieve the formation of a cohesive coating buildup. Van Steenkiste el al improves on this by limiting the amount of cold high pressure carrier gas being injected into the heated high pressure main gas by defining the ratio of the cross sectional area of the bore of the powder injection tube to the area of mixing chamber. This limited the proportion of cold carrier gas mixed into the heated main gas thereby reducing the degree of temperature reduction of the heated high pressure main gas, which then allows for higher gas velocities to be achieved. This provides the ability to accelerate larger particles of a size range greater than 50 microns to a velocity above the critical velocity required to form a cohesively bonded coating buildup. However, the kinetic spray coating method and apparatus of Van Steenkiste et al state an upper limit of the particle size range 106 microns, based on experimental results.

In addition in Alkimov et. al. the main gas is heated upstream of the nozzle, then just upstream of the throat of the nozzle, they introduce the particles and cold carrier gas which lowers the final temperature of the combined main gas/carrier gas/particles. This causes the velocity of the particles to be slower than if the temperature of the main gas was not reduced. Accordingly, in Alkimov a much higher main gas temperature must be used to accommodate the cooling effect of the introduction of the cold carrier gas and particles. With standard electric heaters, the main gas temperature can only be increased to 1300 to 1400 degrees Fahrenheit. This limits the velocity of the particles and hence the size of the particles that produce cohesively formed coatings. Although the pressures of the gases can be increased to increase the velocity of the particles this also increases the complexity and the expense of the system. Accordingly Alkimov is limited to particle sizes of 1 to 50 microns.

SUMMARY OF THE INVENTION

The present invention provides a method and apparatus by which particles of metals, alloys, polymers and mechanical mixtures of the forgoing and with ceramics and semiconductors having a broad range of particle sizes, may be applied to substrates using a novel plasma spray coating method which provides for first feeding the cold high pressure carrier gas with entrained powder particle material into the cold high pressure main gas prior to heating the combined gases and powder and then converging the cold combined gas/powder mixture coaxially into a plasma flame thereby controllably heating the gas as well as the powder particles. The plasma flame can heat the combined gas and particles in excess of 2500 degrees Fahrenheit.

The present invention utilizes a high-pressure plasma generator operating at plasma gas pressures of about 200 psig to 600 psig to produce a very high temperature (about 8,000° F. to about 12,000° F.) plasma flame. A mixture of cold high-pressure gas at a pressure of about 200 psig to about 600 psig, such as air or an inert gas such as argon or helium or a non-reactive gas such as nitrogen, with powder particles entrained in the cold high pressure gas flow is directed to converge coaxially into the high temperature plasma flame and mixing therewith, which causes the powder particles to be heated by the high temperature plasma flame as well as raising the temperature of cold converging high pressure gas. The heated particles in a gas stream consisting of the high temperature plasma gas along with the converged high pressure gas is caused to flow through an extended nozzle to accelerate the gas/powder mixture to a high velocity in the sonic to supersonic velocity range. The centerline of the plasma flame, the converging flow of the cold gas/powder mixture and the centerline of the extended straight bore nozzle are all coaxially aligned. The temperature of the powder particles is elevated to a point below that necessary to cause their thermal softening or melting so that a change in their metallurgical characteristics does not occur. The factors that provide controllability of the temperature of the main high pressure gas mixed with the high pressure carrier/powder gas as well as the particle temperature are the enthalpy of the plasma as well as the volume of high-pressure main/carrier gas mixture. It should be understood that a de Laval nozzle could be substituted for the extended straight bore nozzle in order to achieve higher velocities of the plasma/main gas/carrier gas/powder mixture. A sonic or supersonic flow of the hot gas mixture of plasma/main gas/carrier gas/powder is produced from the extended straight bore or de Laval nozzle and directed as a sonic or supersonic jet of hot gases and particles toward a workpiece surface to be coated. The improvement lies in feeding the cold high pressure carrier gas with entrained powder particle material into the cold high pressure main gas prior to heating the combined gases and powder and then converging the combined gas/powder mixture coaxially into a plasma flame thereby controllably heating the gas as well as the powder particles. The powder particles are controllably heated to the point of less than that required to heat soften the particles, maintaining the in-transit temperature of the particles below the melting point and providing sufficient velocity to the particles to achieve an impact energy upon impact with the workpiece surface capable of transforming the particle kinetic energy to cause elastic deformation to the particles causing them to adhere to the workpiece surface and cohesively build-up a coating thereby forming a dense coating. The improvement over the prior art lays in the fact that, regarding Alkhimov et al, the cold gas dynamic spray method is limited to the use only a particle size range of 1–50 micron. This limitation has been found by Van Steenkiste et al to be due to the heated main high pressure gas being cooled by injecting into it the cold high pressure carrier gas/powder. Because of the reduction in gas temperature, the maximum gas velocity that can be achieved is too low to accelerate powder particles lager than 50 microns to the critical velocity required to achieve the formation of a cohesive coating buildup. Van Steenkiste el al improves on this by limiting the amount of cold high pressure carrier gas being injected into the heated high pressure main gas by defining the ratio of the cross sectional area of the bore of the powder injection tube to the area of mixing chamber. This limited the proportion of cold carrier gas mixed into the heated main gas thereby reducing the degree of temperature reduction of the heated high pressure main gas, which then allows for higher gas velocities to be achieved. This provides the ability to accelerate larger particles of a size range greater than 50 microns to a velocity above the critical velocity required to form a cohesively bonded coating buildup. However, the kinetic spray coating method and apparatus of Van Steenkiste et al state an upper limit of the particle size range 106 microns, based on experimental results. The present invention is novel above the prior art because the cold high pressure carrier gas/powder is injected into the cold high pressure main gas before it is heated. After the step of mixing the carrier and main gas, the combined gas/powder mixture is then heated by mixing it with a very high temperature plasma flame thereby providing the ability to fully control the temperature of the gas mixture prior to acceleration as well as providing a controlled heating of the powder particles. This results in being able to produce higher gas velocities thereby controllably being able to accelerate a very broad range of particle sizes, exceeding 150 microns.

Another object of the invention is to use the cold carrier gas and main gas to cool the nozzle instead of water cooling the nozzle. Typically in a water-cooled non-transferred plasma arc spray system approximately 35% of the energy of the plasma ends up heating the water, which is used to cool the nozzle. By using the cold carrier gas and main gas to cool the nozzle, the plasma is then used to heat the carrier gas and main gas and ends up being a very efficient system.

Another embodiment of this invention provides for the method and apparatus for depositing a coating onto the internal surface of a bore or cylinder or a concave surface. A plasma device as previously described as pail of this invention is radially disposed with respect to the axis of the bore and supported on a member capable of rotating this plasma device around the axis of the bore. The axis of the plasma device is maintained at ali times during the rotation at a perpendicular position relative to the axis of the bore. Rotating fittings are provided to carry the necessary gases, powder feedstock and electrical power to the rotating plasma device. The plasma device functions in the same manner as the plasma devices previously described as part of this invention. The powder feed stock can be pre-mixed with the main cold gas at a point prior to entering the rotating plasma apparatus or it may be injected or mixed into the main cold gas flow within the plasma device at the point where it enters the plasma torch assembly. A non-transferred high-pressure plasma is established between the cathode electrode and the anode nozzle within the plasma torch forming a plasma flame, into which a high-pressure flow of a mixture of gas and powder particles is caused to converge coaxially into the plasma flame. The high-pressure gas flow can be air or it can be an inert gas such as argon or helium or a non-reactive gas such as nitrogen. The powder particle temperature is elevated to a level below its thermal softening point. The heated particles in the gas stream consisting of the high temperature plasma gas along with the converged high pressure gas flow is caused to flow through an accelerating nozzle such as an extended straight nozzle or a de Laval nozzle to accelerate the gas powder mixture to a high velocity. A sonic or supersonic jet of the hot gas mixture of plasma/gas/powder is produced from the accelerating nozzle and directed as a sonic or supersonic jet of hot gases and particles towards a workpiece surface to be coated. The centerline of the plasma generator and the accelerating nozzle are coaxially aligned. However the axis of rotation of the plasma generator and accelerating nozzle is perpendicular to the axis of rotation of the assembly. As the assembly is rotated and the assembly is traversed axially along the internal surface of the bore is coated. The improvement lies in rotating the plasma generator and accelerating nozzle perpendicular to the axis of rotation, about the axis of rotation, and in the feeding of powder particle material typically with a particle size range greater than 50 microns entrained in a high pressure, high volume carrier gas (typically compressed air) coaxially converging into the plasma flame of the high pressure plasma generator and flowing the plasma/gas/powder mixture into and through an accelerating nozzle such as a straight bore nozzle or a de Laval nozzle, thereby controllably heating the powder particles to a point lower than their thermal softening point and maintaining the in-transit temperature of the particle below the melting point and providing sufficient velocity to the particles to achieve an impact energy upon impact with the workpiece surface capable of transforming the kinetic energy of the particles to cause elastic deformation to the particles causing them to adhere to the workpiece surface and cohesively build-up a coating thereby forming a dense coating while rotating the plasma apparatus perpendicularly about an axis of rotation.

Accordingly, it is an object of the invention to provide an improved high pressure plasma spray apparatus for applying a coating utilizing particle kinetics.

A further object of the invention is to provide a high pressure plasma apparatus and process in which a sonic or supersonic gas jet is created to cause heating of powder particles typically greater than 50 microns, to a temperature below their melting point and accelerating them to a velocity such that when they impact with the coating surface, their kinetic energy is transformed into plastic deformation of the particles causing them to adhere to the workpiece surface and build-up a coating thereby forming a dense coating.

Yet another object of the invention is to provide a high-pressure plasma apparatus and process suitable for coating the internal surfaces of a bore, cylinder or concave surface in which a sonic or supersonic gas jet is created to cause heating of powder particles typically greater than 50 microns, to a temperature below their melting point and accelerating them to a velocity such that when they impact with the coating surface, their kinetic energy is transformed into plastic deformation of the particles causing them to adhere to the workpiece surface and build-up a coating by providing a means of rotation to the high-pressure plasma apparatus such that the plasma assembly is perpendicularly oriented with respect to the axis of rotation.

A further object of the invention is to provide a method and apparatus for producing high performance well bonded coatings, which are substantially uniform in composition and have very high density with very low oxides content formed within the coating.

Still other objects and advantages of the invention will in part be obvious and will in part be apparent from the specification.

The invention accordingly comprises the several steps and the relation of one or more of such steps with respect to of the others, and the apparatus embodying features of construction, combination of elements, and arrangement of parts which are adapted to effect such steps, all as exemplified in the following detailed disclosure, and the scope of the invention will be indicated in the claims.

BRIEF DESCRIPTION OF THE DRAWINGS

For a fuller understanding of the invention, reference is made to the following description taken in connection with the accompanying drawings, in which.

FIG. (6) is an end view diagram of a HPPS apparatus constructed in accordance with an embodiment of the invention, which includes means for rotating the HPPA apparatus perpendicularly about an axis of rotation.

DETAILED DESCRIPTION OF THE PREFERRED EMBODIMENTS

Figure 1:
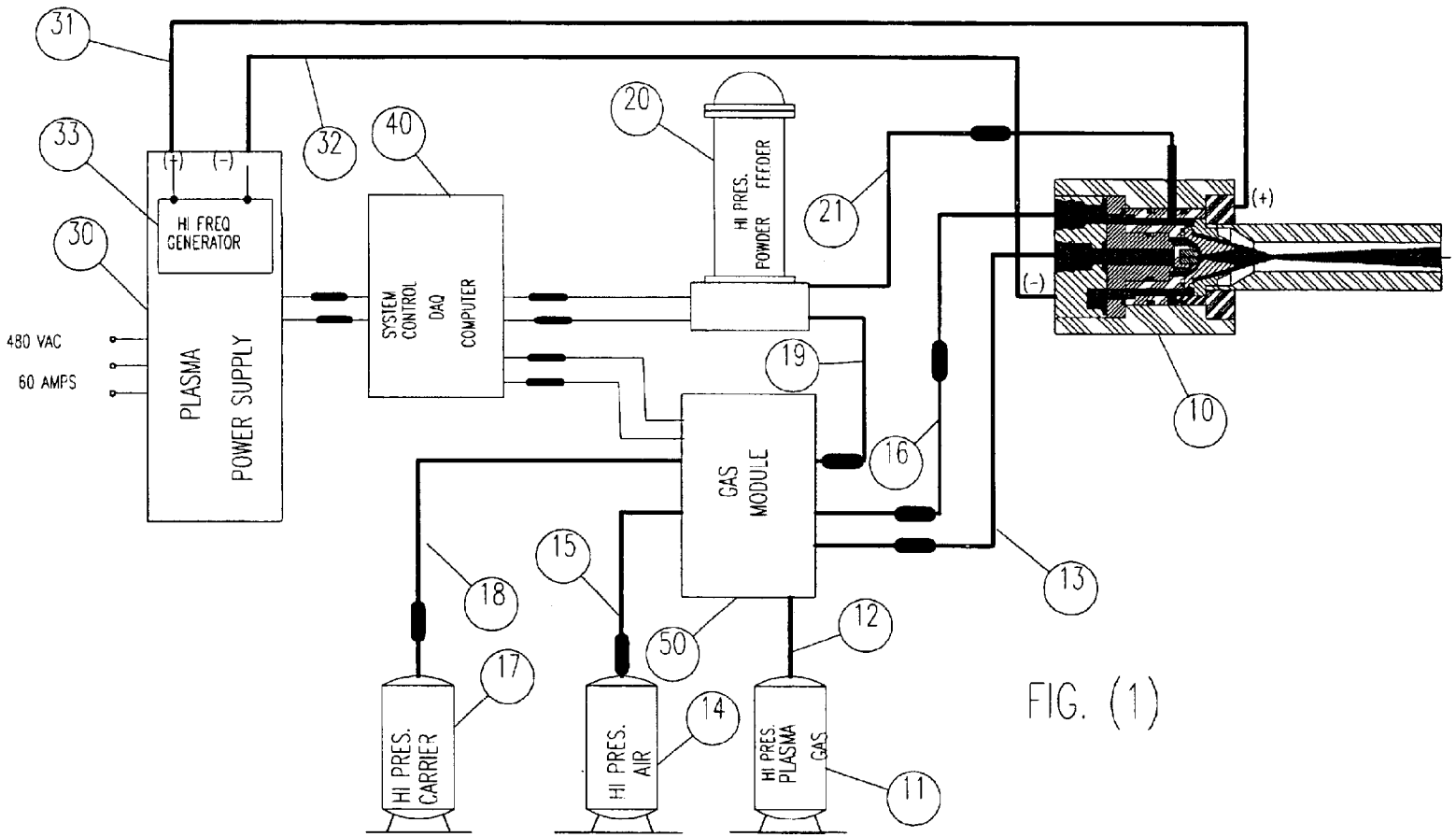
FIG. 1 is a schematic diagram of a high-pressure plasma spray apparatus (HPPS) constructed in accordance with an embodiment of the invention.

Reference is first made to FIG. 1 in which a high-velocity plasma spray apparatus constructed in accordance with the invention includes a high pressure plasma spray (HPPS) assembly 10, a high pressure powder feeder assembly 20, a plasma power supply 30, a system control console 40 and a gas module 50. A high pressure plasma gas 11 which typically could be argon, nitrogen or a mixture of argon/hydrogen and having a pressure of between 200 psig and 600 psig, is fed to the gas module 50 through hose 12 and them fed from the gas module 50 through hose 13 to the HPPS torch assembly 10. Electrical power is supplied to the HPPS 10 from the plasma power supply 30 by means of cables 31 and 32. High-pressure compressed gas 14, which can be air, nitrogen, helium or any mixture of these gases and having a pressure of between 200 psig and 600 psig, is supplied to the gas module 50 by means of hose 15 and then fed to the HPPS torch assembly through hose 16. The high pressure carrier gas 17 having a pressure of between 200 psig and 600 psig is supplied to the gas module 50 through hose 18 and then fed from the gas module 50 to the high-pressure powder feeder 20 by means of hose 19. From the high pressure powder feeder 20 high pressure carrier gas 17 with powder feed stock entrained in it by the high pressure powder feeder 20 is fed to the HPPS 10 by means of hose 21. A system control assembly 40 controls the plasma power supply 30 as well as the gas module 50 and the high pressure powder feeder 20.

Figure 2:
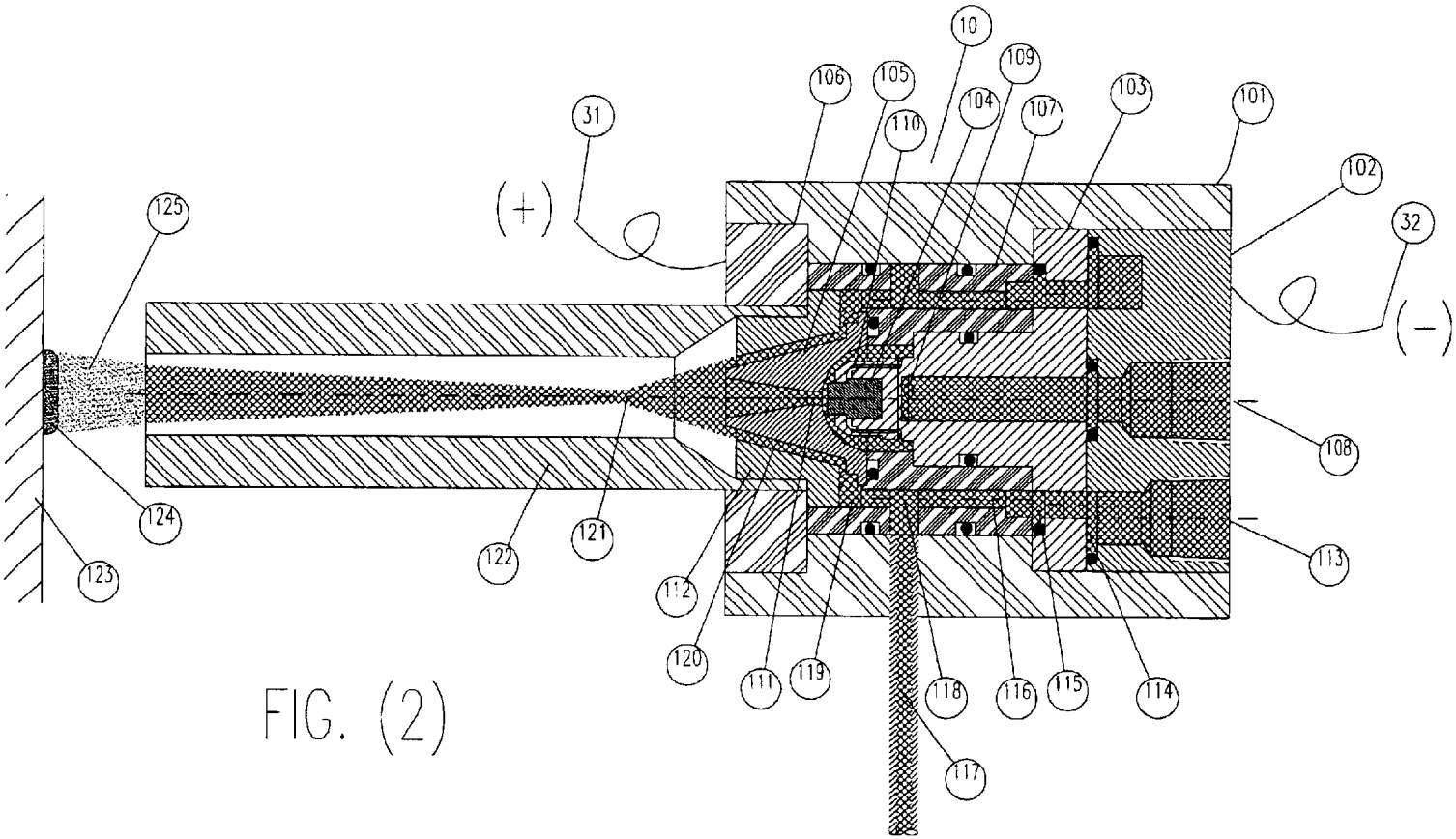
FIG. 2 is a cross-sectional view of a HPPS apparatus constructed in accordance with an embodiment of the invention, which includes the use of an extended straight bore nozzle.

Reference is now made to FIG. 2 in which an enlarged cross-sectional view of a HPPS torch assembly 10 is shown. The HPPS torch assembly includes a housing 101. A gas inlet block 102 is disposed within the housing 101 coaxially with a cathode support 103. A cathode assembly 104 is attached to the cathode support block 103 and coaxial therewith. A cup-shaped plasma nozzle 105 is disposed about cathode 104 and the cathode support block 103 and the cathode assembly 104 are coaxially aligned within the plasma nozzle support block 106 and electrically insulated from the plasma nozzle by means of insulating sleeve 107 also coaxially aligned with the cathode support block 103 and the cathode assembly 104.

Gas inlet block 102 is formed with a plasma gas inlet port which receives plasma gas and provides its passage through cathode support 103 exiting through tangentially oriented ports 109, formed within the cathode support. Ports 109 communicate at a right angle with a chamber 110 formed between the cathode electrode 104 and the inner surface of the cup shape plasma nozzle 105. As the plasma gas exits the tangential ports 109 into chamber 110, which is formed between the cathode assembly 104 and the plasma nozzle 105, the plasma gas is formed into a strong vortex flow around the cathode 104 and exits the plasma nozzle constricting orifice. 111 formed within the plasma nozzle 105.

A cup shaped main gas nozzle 112 is disposed about plasma nozzle 105. A high pressure main gas is fed into a main gas inlet port 113 located in the gas inlet block 102. The main high pressure gas flows through the gas inlet block 102 to a manifold 114 within the gas inlet block 102 which the passes through a series of ports 115 within the cathode support 103. The main gas is then caused to flow in an evenly distributed manner into and through ports 116 in thee electrical insulator 107. A carrier gas and powder inlet tube 117 is located so that it can direct the carrier gas and powder into the main gas flow at a point 118 which is located such that this carrier gas and powder mixes with and evenly distributes itself into the main gas flow within the electrical insulator 107. It should be understood that the carrier gas and powder can also be mixed into the main gas flow prior to the main gas entering the HPPS torch at the main gas inlet port 113, thereby eliminating the need for a separate carrier gas and powder inlet tube 117. The combined main gas and carrier gas with the powder particles evenly distributed within, flows into a manifold formed between the plasma nozzle 105 and the cup shaped gas nozzle 112 and then flows through the conically shaped space 120 formed between the cup shaped gas nozzle 112 and the outer surface of the plasma nozzle causing the combined gas flow to coaxially converge at a point 121 downstream of the plasma nozzle 105. The negative output of the power supply 30 is connected through lead 32 to the central cathode electrode 104 of the HPPS torch assembly 10. The positive output of the power supply 30 is connected to the plasma nozzle through electrical power lead 31 so that the plasma nozzle is an anode.

Downstream from the plasma nozzle 105 and coaxially aligned with the plasma nozzle 105 and the cup shaped main gas nozzle 112 is a extended straight bore nozzle 122 which is attached and is a part of the HPPS torch assembly 10. This extended straight bore nozzle 122 is constructed such that its length is at least six (6) times longer than the diameter of its bore. The purpose of the extended bore nozzle 122 to provide a means of causing the total gas flow from the plasma torch 10 with powder particle entrained in the gas to be accelerated to sonic or supersonic speeds, thereby providing the kinetic energy to the powder particles 125 necessary to form a cohesively bonded coating 124 upon impact with the work surface 123.

In operation of the system, a high pressure plasma gas 11 is caused to flow through hose 12 to the gas module 50 and then through hose 13 to the HPPS torch assembly 10. Additionally high pressure main gas 14 is caused to flow through hose 15 to the gas module 50 and then through hose 16 to the HPPS torch assembly. After an initial period of time, typically two seconds, DC power supply 30 is electrically energized as well as the high frequency generator 33 which is internal to the power supply 30 causing a pilot plasma to be momentarily established. This pilot plasma causes the formation of a high-energy DC plasma formed by an arc current established between the cathode 104 and the plasma nozzle 105. Instantly with the establishment of the high energy DC plasma, the high frequency generator 33 is de-energized. The DC high energy plasma causes a stream of high pressure hot, ionized gas to flow out of the plasma nozzle 105 mixing with the converging cold high pressure main gas thereby causing the cold main gas to be heated to a controllably set temperature. Once the plasma has been established in a stable manner, high pressure carrier gas 17 is caused to flow through hose 18 to the gas module 50 and then through hose 19 to the high pressure powder feeder 20. Powder particles of feed stock material are entrained in the carrier gas 17 as it flows through the powder feeder 20 and are caused to flow through hose 21 to the HPPS torch assembly 10 where the high pressure carrier gas 17 and powder enters the torch assembly 10 through tube 17 and is mixed into the cold high pressure main gas 14 at a point 18 so that the carrier gas 17 and powder particles can be distributed within the main gas flow before the gases enter and flow through the conically shaped passage 120 formed between the outer surface of the plasma nozzle and the inner surface of the cup shaped main gas nozzle 112. As the cold main gas 14 mixed with the cold carrier gas 17 with the powder particle entrained exits the conically shaped passage 120 it converges and mixes with the axial flow of the hot, ionized plasma gas which is exiting the plasma nozzle 105. The mixing of the hot and cold gases results in a gas temperature which is controllable and is based on the volume, temperature and enthalpy of the plasma gas and the volume and temperature of the main gas mixture and is desirably adjusted to a temperature which is as high as possible while not exceeding the melting or softening point of the powder material.

Figure 3:
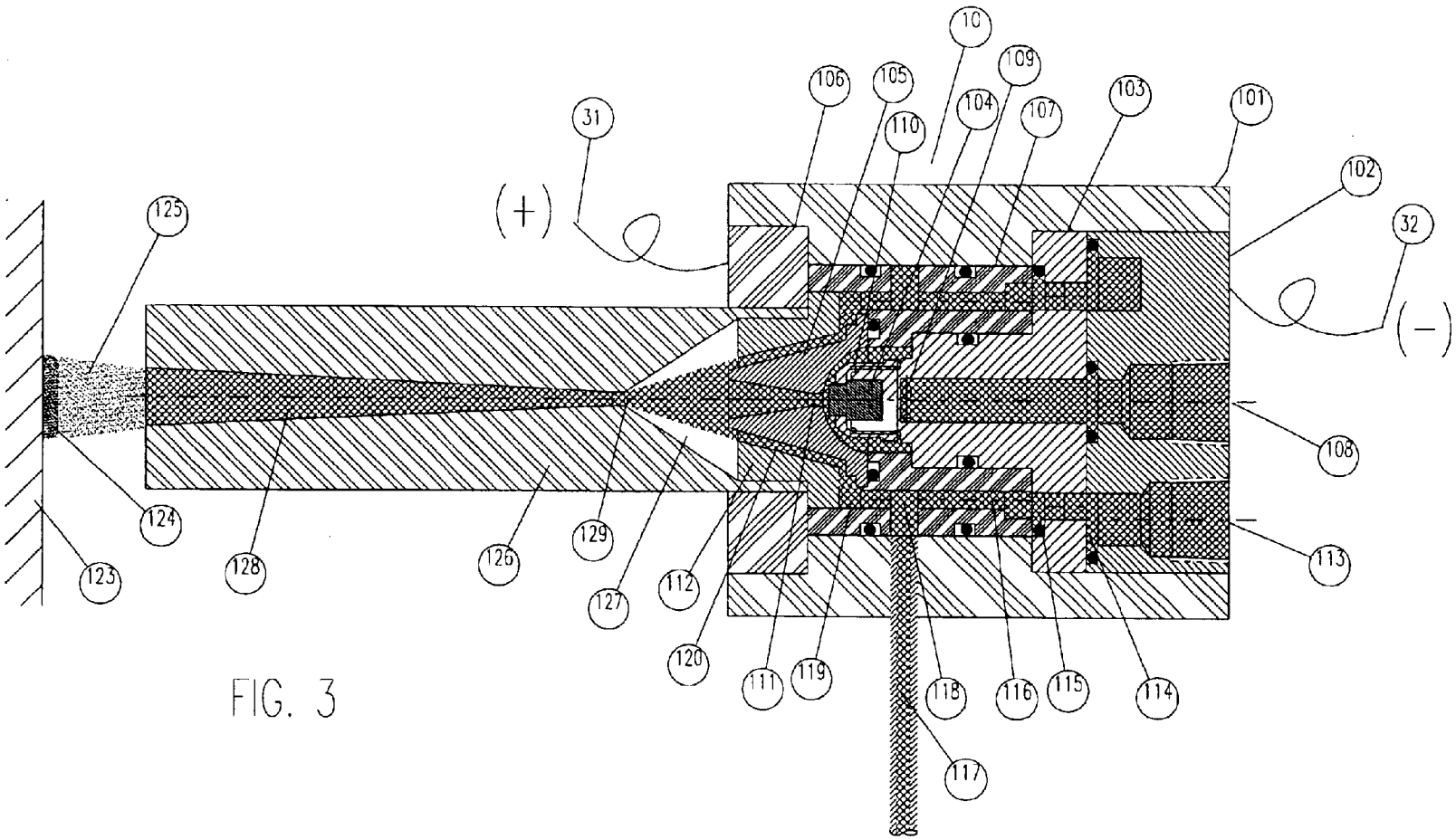
FIG. 3 is a cross-sectional view of a HPPS apparatus constructed in accordance with an embodiment of the invention, which includes the use of an extended de Laval nozzle.

Reference is now made to FIG. 3 in which a preferred embodiment of the invention is shown. Like numbers are utilized to indicate like parts, the difference between the embodiment of FIG. 2 and that of FIG. 3 being the use of a de Laval nozzle 126 instead of the straight bore nozzle 122. The de Laval nozzle consists of three sections, the convergent section 127 and the divergent section 128 and the critical orifice 129. The employment of a de Laval nozzle 126 provides for improved fluid dynamic flow resulting in producing higher velocities of the exiting gas thereby accelerating the powder feedstock entrained within the gas to higher velocities. This higher velocity of the powder feedstock is required to produce improved coating efficiencies as well as higher coating quality.

Figure 4:
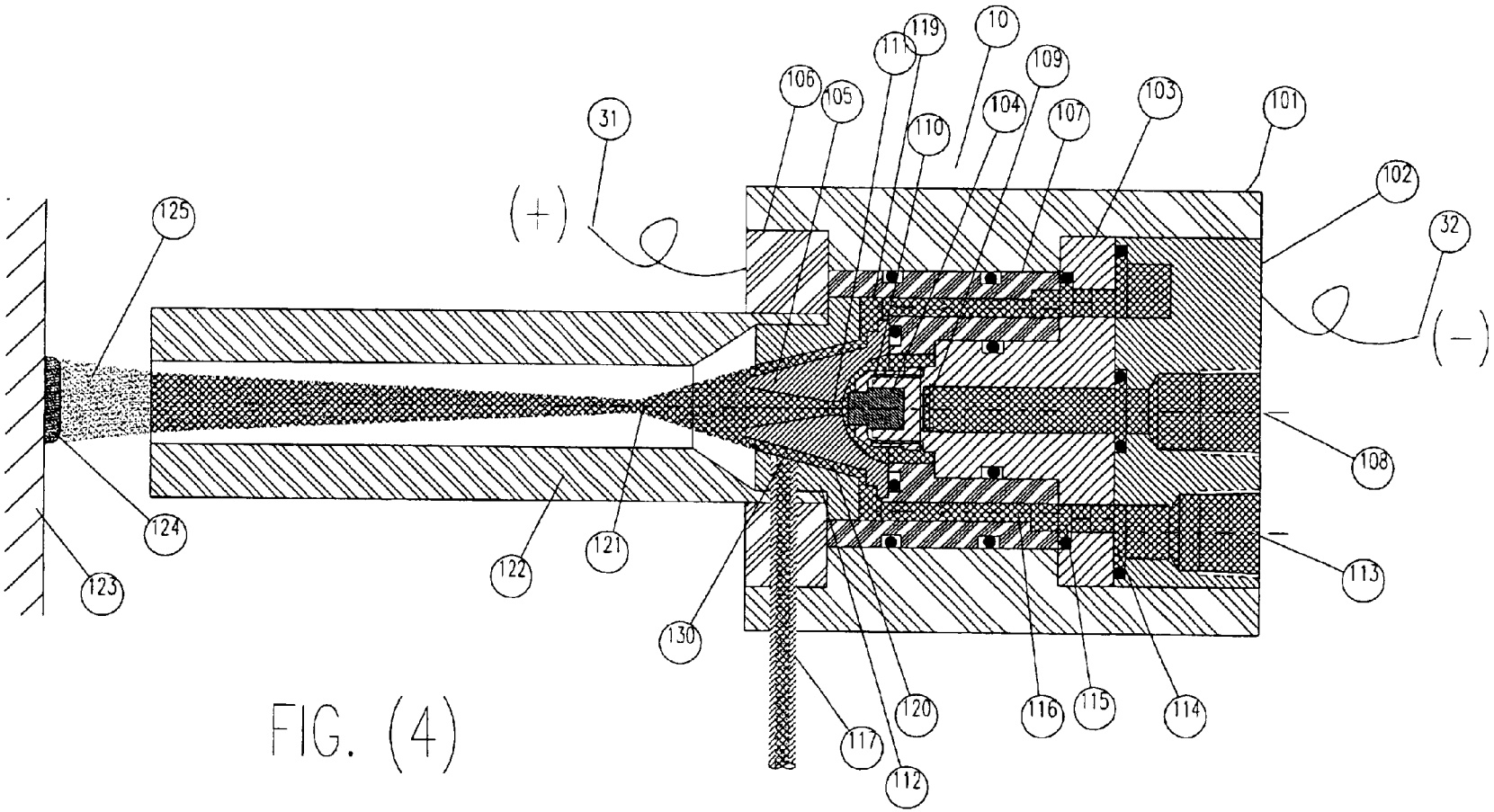
FIG. 4 is a cross-sectional view of a HPPS apparatus constructed in accordance with an embodiment of the invention, which includes the use of an extended straight bore nozzle and illustrates an alternative means of injecting powder particles upstream of the converging point of the plasma flame and the cold high-pressure gas flow.
Figure 5:
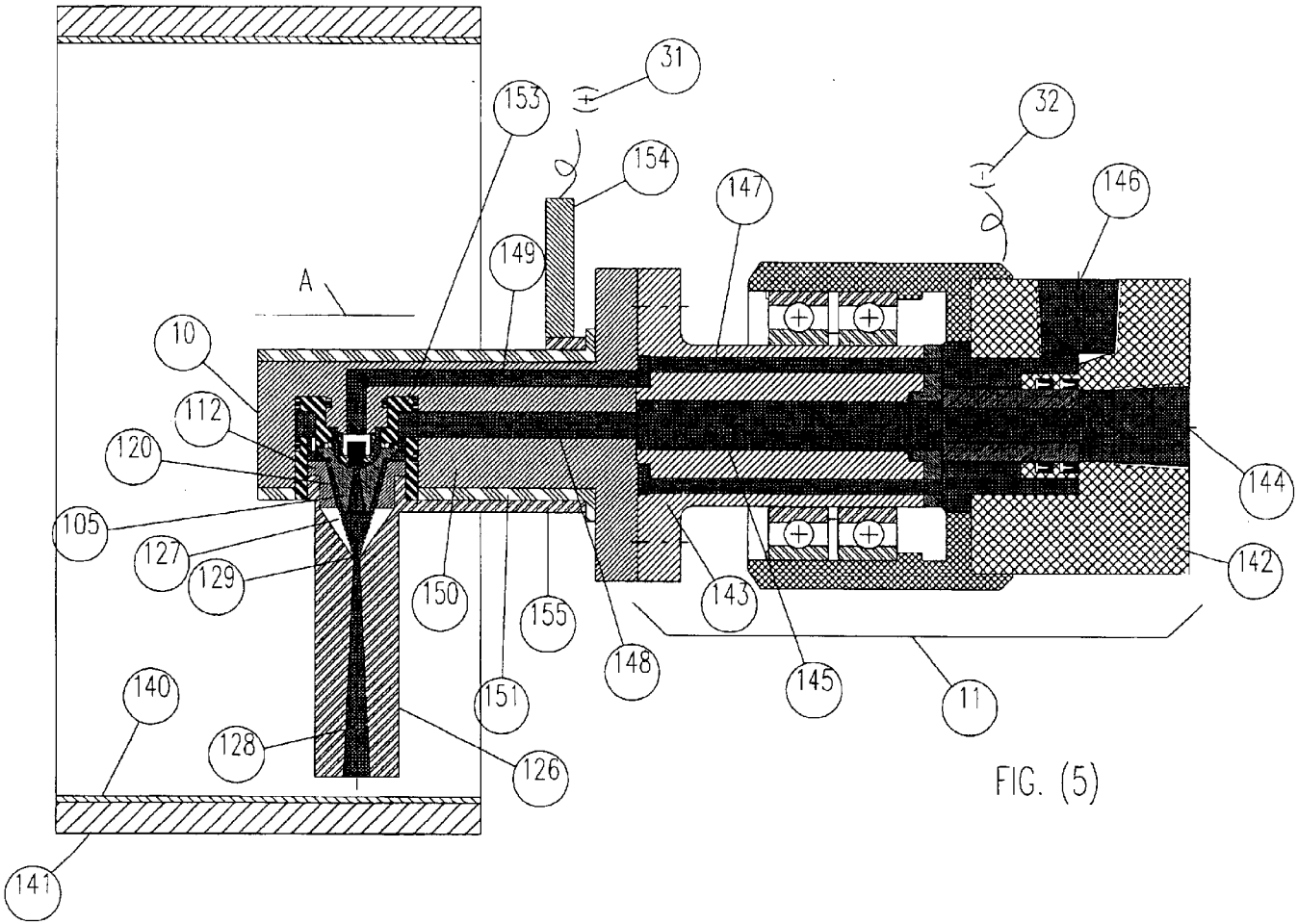
FIG. 5 is a cross-sectional diagram of a HPPS apparatus constructed in accordance with an embodiment of the invention, which includes means for rotating the HPPA perpendicularly about an axis of rotation in order to deposit a coating on the internal surface of a bore, cylinder or concave surface.
Figure 6:
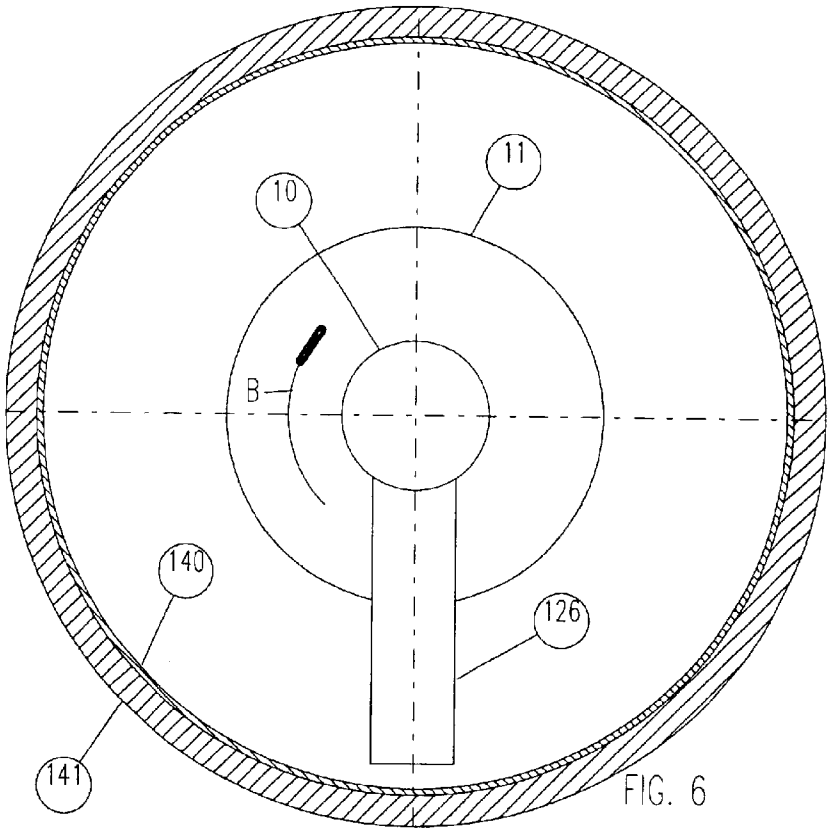

In reference to FIG. 4, this cross-sectional drawing of the HPPS torch is the same as the previously described HPPS torch assembly of this invention as shown in FIG. 2 with the exception that an alternative point 130 is illustrated for the injection of the carrier gas and powder as compared to the injection point 118 of FIG. 2. Like numbers are utilized to indicate like parts. As is shown, the point 130 is located within the conically shaped space 120 formed between the cup shaped gas nozzle 112 and the outer surface of the plasma nozzle 105. Injecting the carrier gas and powder into the main gas flow at this point 130 provides the same advantage as injecting it at a point upstream in the main gas flow such as at point 118 of FIG. 2 or even to pre-mix the carrier gas and powder with the main gas before the main gas flow enters the HPPS torch assembly at main gas inlet port 113.

Reference is now made to FIGS. (5) and (6) in which a cross-section and end view diagram of a HPPS assembly 10 to be employed in a manner suitable for depositing a uniform coating 140 on the concave surface such as a bore 141 is shown. This embodiment includes a HPPS torch assembly 10 similar to HPPS torch assembly 10 described in FIG. (2), the difference being that HPPS torch assembly 10 is mounted on a rotating member 142 to allow rotation concentrically with respect to bore 141 by means of a motor drive, not shown.

The HPPS rotating spray assembly consists of a HPPS torch assembly 10 and a rotating union assembly 11, which typically can be a commercial two-port rotating union such as a Model No. 1590 manufactured by the Deublin Company. The rotating union 11 consists of a stationary gas block 142 and a rotating member 143. Contained on the gas inlet block 142 are a main gas inlet port 144 and a plasma gas inlet port 146. Contained within the rotating union 11 are a passageway 145, which is a central duct through which the main gas with powder feedstock particle entrained therein flows through, and a passageway 147 through which the plasma gas flows. Attached to the rotating member 143 of the rotary union 11 is a HPPS torch assembly 10. HPPS torch assembly 10 is mounted at an end of rotating member 142 opposite that of stationary block 143 on the radius of rotating member 142 so that the central axis of the HPPS torch assembly 10 is perpendicular axis of rotation. The HPPS torch assembly 10 is mounted onto the rotating member 143 of the rotary union in such a manner so that the gas passageway 143 of the rotary union 11 is aligned with passageway 148 in the HPPS torch assembly 10 and passageway 147 of the rotary union 11 is aligned with passageway 149 of the HPPS torch assembly 10, thereby providing means for the main gas with powder feedstock particle entrained therein as well as the plasma gas to flow into and through passageways 148 and 149 respectively in the HPPS torch assembly 10. Electrical power is brought to the HPPS torch assembly from the plasma power supply 30 of FIG. (1). The negative connection is brought from the power supply 30 through lead 32 to the stationary block 142 and then is conducted through the body of rotary union 11 to the cathode block 150 of the HPPS torch assembly. Surrounding the cathode block 150 is an insulating sleeve 151 providing electrical insulation between the cathode body 150 and thee plasma anode nozzle 105. Additionally, electrical insulation is provided between the cathode block 150 and the anode plasma nozzle 105 by means of insulating sleeve 153. The positive connection from the plasma power supply 30 to the HPPS torch assembly 10 is made through lead 31 which is connected to a brush assembly 154 which commutates the electrical power to an outer jacket 155 which is electrically connected to the plasma anode nozzle 105. Insulating sleeve 153 additionally serves to manifold the main gas and powder flow in order to uniformly distribute this flow through the passageway 120 which is formed between the outer surface of the plasma anode nozzle 105 and the inner surface of the cup shaped nozzle 112. The functioning of the HPPS torch assembly 10 of this HPPS rotating assembly is similar to the function and operation of the HPPS torch assembly 10 of FIG. (2) whereby the cold main gas with powder particles entrained therein is caused to flow into a high temperature plasma which is emanating from the plasma anode nozzle 105. As the two gas streams mix, the temperature of the cold main gas is raise to a high temperature limited to be below the melting or softening point of the powder material. The velocity of the now heated gas and powder stream is accelerated to sonic or supersonic velocity as the gas stream flows through the de Laval nozzle 126. As the high velocity powder particles exit the de Laval nozzle 126 they deposit themselves onto the inner surface of the bore 141. As the coating process proceeds, the HPPS torch assembly is caused to rotate about the centerline of the bore 141 while simultaneously being laterally traversed through the bore 141 thus forming a dense coating buildup 140 uniformly over the desired area of the inner surface of the bore 141.

In the prior art, it has been commonly known that if it is desired to apply a thermal spray coating to an internal surface, prior art cold gas dynamic spray and kinetic spray devices as well as most thermal spray apparatuses, equipped with a deflector head, deflecting the spray pattern 90° is employed and the part to be coated is independently rotated while the spray apparatus is reciprocated up and back along the axis of the concave surface. However, it is not always practical or possible to rotate the part to be coated, such as an automobile engine block, when it is desired to apply a coating to the cylinder bores contained within the engine block. By providing a HPPS torch assembly which is rotatably mounted and rotated about the centerline of a bore while being radially positioned relative to the bore axis a practical process for applying a coating to the inner surface of a concave structure such as a bore is provided.

It will thus be seen that the objects set forth above, among those made apparent from the preceding descriptions, are efficiently attained and, since certain changes may be made in carrying out the above method and in the constructions set forth without departing from the spirit and the scope of the invention, it is intended that all matter contained in the above descriptions and shown in the accompanying drawings shall be interpreted as illustrative and not in a limiting sense.

It is also to be understood that the following claims are intended to cover all the generic and specific features of the invention herein described and all statements of the scope of the invention, which, as a matter language, might be said to fall there between.

What is claimed is:

1. A method for applying a coating of powder particles to an article, the coating being formed of a cohesive layering of the particles in solid state on the surface of the article, the method comprising:

first mixing powder particles and a carrier gas with a main gas, wherein the main gas has a pressure between about 200 psig and about 600 psig, and subsequently heating the mixture of gases and particles with a plasma flame to an elevated temperature, which is controlled to be below the thermal softening temperature of the particles;

subsequently accelerating the heated mixture of gases and particles into a supersonic jet and directing the jet of gases and particles in a solid state against the article so that the particles are caused to adhere to the article and build the cohesive coating.

2. The method of claim 1, wherein the mixture is mixed with a plasma flame to heat the mixture to a temperature below the thermal softening temperature of the particles.

3. The method of claim 1, wherein the carrier gas has a pressure between about 200 psig and about 600 psig.

4. The method of claim 1, wherein the particles have a particle size in excess of 50 microns.

5. The method of claim 1, wherein the particles are of a size range, which is less than about 150 microns.

6. The method of claim 1, wherein the step of controlling the temperature of the mixture of gases and particles is performed by adjusting the enthalpy of the plasma flame.

7. The method of claim 1, wherein the powder particles are of at least one first material selected from the group of a metal, alloy, mechanical mixture or a metal and an alloy, and a mixture of at least one of a polymer, a ceramic and a semiconductor with at least one of a metal, alloy and a mixture of a metal and an alloy.

8. The method of claim 1, wherein the particles are accelerated to a velocity of from about 300 to about 1,200 meters/second.

9. The method of claim 1, wherein the carrier gas and main gas are selected from the group consisting of air, nitrogen, helium or a mixture thereof.

10. The method of claim 1, wherein the plasma gas is selected from the group consisting of argon, argon/hydrogen or nitrogen.

11. A method of applying a coating to an article, the coating being formed of a cohesive layering of the powder particles in solid state on the surface of the article, the method comprising;

first mixing the powder particles and a carrier gas, wherein the particles of powder have a particle size in excess of 50 microns and are of at least one first material selected from the group consisting of a metal, alloy, mechanical mixture of a metal and an alloy or a mixture of at least one of a polymer, a ceramic and a semiconductor with at least one of a metal, alloy and a mixture of a metal and an alloy, with a main gas, wherein the main gas has a pressure between about 200 psig and about 600 psig; and second, heating the mixture of gases and particles with a plasma flame to an elevated temperature, which temperature is controlled to be below the thermal softening temperature of the particles; and third, accelerating the mixture of elevated temperature gases and particles into a supersonic jet having a velocity of from about 300 to about 1,200 m/sec; and directing the supersonic jet of gas and particles in a solid state against an article of a second material selected from the group consisting of a metal, alloy, semiconductor, ceramic and plastic, and a mixture of any combination thereof, thereby coating the article with a desired thickness of particles.

12. The method of claim 11, wherein the caner gas pressure and the main gas pressure are between about 200 psig and about 600 psig.

13. The method of claim 11, wherein the particles are of a size range of less than about 150 microns.

14. The method of claim 11, wherein the plasma gas is selected from the group consisting of argon, argon/hydrogen or nitrogen.

15. The method of claim 11, wherein the carrier gas and the main gas are selected from the group consisting of air, nitrogen or helium or a mixture thereof.

16. A method of applying a coating to an article, the coating being formed of a cohesive layering of the powder particles in solid state on the surface of the article, the method comprising;

first mixing the powder particles and a carrier gas, wherein the particles of powder are of a size range from about 1 micron to about 50 microns and are of at least one first material selected from the group consisting of a metal, alloy, mechanical mixture of a metal and an alloy or a mixture of at least one of a polymer, a ceramic and a semiconductor with at least one of a metal, alloy and a mixture of a metal and an alloy, with a main gas, wherein the main gas has a pressure between about 200 psig and about 600 psig; and second, heating the mixture of gases and particles with a plasma flame to an elevated temperature, which temperature is controlled o be below the thermal softening temperature of the particles; and third, accelerating the mixture of elevated temperature gases and particles into a supersonic jet having a velocity of from about 300 to about 1,200 m/sec; and directing the supersonic jet of gas and particles in a solid state against an article of a second material selected from the group consisting of a metal, alloy, semiconductor, ceramic and plastic, and a mixture of any combination thereof, thereby coating the article with a desired thickness of particles.

17. A method for applying a coating of powder particles to an article, the coating being formed of a cohesive layering of the particles in solid state on the surface of the article, the method comprising:

first mixing powder particles and a carrier gas, wherein the carrier gas has a pressure between about 200 psig, to about 600 psig with a main gas, and subsequently heating the mixture of gases and particles with a plasma flame to an elevated temperature, which is controlled to be below the thermal softening temperature of the particles;

subsequently accelerating the heated mixture of gases and particles into a supersonic jet and directing the jet of gases and particles in a solid state against the article so that the particles are caused to adhere to the article and build the cohesive coating.

18. The method of claim 17, wherein the mixture is mixed with a plasma flame to heat the mixture to a temperature below the thermal softening temperature of the particles.

19. The method of claim 17, wherein the particles have a particle size in excess of 50 microns.

20. The method of claim 17, wherein the particles arc of a size range, which is less than about 150 microns.

21. The method of claim 17, wherein the step of controlling the temperature of the mixture of gases and particles is performed by adjusting the enthalpy of the plasma flame.

22. The method of claim 17, wherein the powder particles are of at least one first material selected from the group of a metal, alloy, mechanical mixture of a metal and an alloy, and a mixture of at least one of a polymer, a ceramic and a semiconductor with at least one of a metal, alloy and a mixture of a metal and an alloy.

23. The method of claim 17, wherein the particles are accelerated to a velocity of from about 300 to about 1,200 meters/second.

24. The method of claim 17, wherein the carrier gas and main gas are selected from the group consisting of air, nitrogen, helium or a mixture thereof.

25. The method of claim 17, wherein the plasma gas is selected from the group consisting of argon, argon/hydrogen or nitrogen.

26. A method of applying a coating to an article, the coating being formed of a cohesive layering of the powder particles in solid state on the surface of the article, the method comprising;

first mixing the powder particles and a carrier gas, wherein the carrier gas has a pressure between about 200 psig, to about 600 psig and wherein the particles of powder have a particle size in excess of 50 microns and are of at least one first material selected from the group consisting of a metal, alloy, mechanical mixture of a metal and an alloy or a mixture of at least one of a polymer, a ceramic, and a semiconductor with at least one of a metal, alloy and a mixture of a metal and an alloy, with a main gas; and second, heating the mixture of gases and particles with a plasma flame to an elevated temperature, which temperature is controlled to be below the thermal softening temperature of the particles; and third, accelerating the mixture of elevated temperature gases and particles into a supersonic jet having a velocity of from about 300 to about 1,200 m/sec; and directing the supersonic jet of gas and particles in a solid state against an article of a second material selected from the group consisting of a metal, alloy, semiconductor, ceramic and plastic, and a mixture of any combination thereof, thereby coating the article with a desired thickness of particles.

27. The method of claim 26, wherein the main gas pressure arc between about 200 psig and about 600 psig.

28. The method of claim 26, wherein the particles are of a size range of less than about 150 microns.

29. The method of claim 26, wherein the plasma gas is selected from the group consisting of argon, argon/hydrogen or nitrogen.

30. The method of claim 26, wherein the carrier gas and the main gas are selected from the group consisting of air, nitrogen or helium or a mixture thereof.

* * * * *